United States Patent [19]

Preston et al.

[11] Patent Number: 4,676,468

[45] Date of Patent: Jun. 30, 1987

[54] PORTABLE CARRIER DEVICE FOR TEMPORARY ATTACHMENT TO A SUPPORT

[76] Inventors: Keith Preston, 88 Thornhill Road, Streetly, Sutton Coldfield; Michael J. Preece, 3 Bellsmoor Road, Hill Top, West Bromwich, West Midlands, both of England

[21] Appl. No.: 849,959

[22] Filed: Apr. 9, 1986

[30] Foreign Application Priority Data

Apr. 12, 1985 [GB] United Kingdom ..... 8509481

[51] Int. Cl.[4] ..... E04G 3/08; E06B 7/28

[52] U.S. Cl. ..... 248/238; 182/120; 182/129; 248/211

[58] Field of Search ..... 248/238, 237, 236, 211; 182/120, 129

[56] References Cited

U.S. PATENT DOCUMENTS

| | | | |
|---|---|---|---|
| 1,714,028 | 5/1929 | Knuth | 182/120 |
| 2,585,150 | 2/1952 | McGill | 182/120 |
| 2,775,489 | 12/1956 | Hagadorn | 182/129 |
| 3,268,196 | 8/1966 | Anton | 182/129 X |
| 3,757,380 | 9/1973 | Jackson | 248/211 X |

FOREIGN PATENT DOCUMENTS

| | | |
|---|---|---|
| 1578344 | 11/1980 | United Kingdom . |
| 2135378 | 8/1984 | United Kingdom . |

*Primary Examiner*—Dennis L. Taylor

*Attorney, Agent, or Firm*—Leydig, Voit & Mayer

[57] ABSTRACT

A paint pot carrier comprises a unitary moulded body defining a pot-receiving well (3). A hooking web (8) of the body enables the carrier to be hooked over a ladder rung (R), an inclined shoulder (14 or 15) bearing against an adjacent one of the ladder stiles (S). Two movable jaws (20,21) can be raised to clamp the rung from beneath against the web (8). To move the jaws, rack teeth (26) of the jaws are engaged by pinions (25) secured to a common drive shaft (27). Rack teeth of a drive bar (30) engage a toothed central portion (28) of the shaft (27), and manually operable means (34–39 or 48–60) enables the drive bar to be moved longitudinally to operate the jaws.

10 Claims, 9 Drawing Figures

PORTABLE CARRIER DEVICE FOR TEMPORARY ATTACHMENT TO A SUPPORT

This invention is concerned with a portable device adapted to be secured temporarily to a suitable support for bearing materials, tools or other requisites for a person doing a job of work at that location. Such a device may be so arranged as to enable it to be fitted to various kinds of attachment point.

Many ladder attachments have been proposed in the past. Often they have comprised a carrying tray embodied in a ladder stay, for example as described in U.K. patent specification Nos. 2 135 378A and 1 578 344, for use primarily by painters and decorators. Other examples of carriers for paint pails and applicators are to be found described in U.S. Pat. Nos. 3,757,380 and 3,857,537.

It is an object of the present invention to provide an improved carrier device which can readily be clamped securely to a suitable support.

It is another object of the present invention to provide an improved paint pot or pail carrier attachable to a ladder.

In accordance with the invention in one of its aspects there is provided a portable device adapted to be secured temporarily to a suitable support for bearing materials, tools or other requisites for a person doing a job of work at that location, the device comprising clamping means comprising at least one movable jaw and operating means whereby the jaw can be moved towards an opposed portion of the device to grip a support therebetween, the operating means comprising a rotatable drive shaft, a pinion wheel which engages rack teeth of the jaw and is rotatable by the drive shaft, and shaft rotating means whereby the drive shaft can be rotated to rotate the pinion to drive the jaw towards said opposed portion of the device to clamp a support.

Such a device described hereinafter by way of example is in the form of a paint carrier providing a well in which a paint tin (or other similar vessel) can be securely lodged but within the scope of the invention such carriers may take other forms to suit them for other purposes.

Furthermore, such a carrier may be provided with additional means increasing its versatility and enabling it to be fitted instead, as occasion demands, to other attachment points such as step ladders, chair backs, central heating radiators, window sills and table tops.

In accordance with the invention in another of its aspects a portable device for temporary attachment to a ladder for bearing a paint pot or pail for a person working from the ladder, the device comprising a unitary moulded plastics body forming a well to receive the pot or pail and providing hooking means enabling the device to be hooked over a rung of the ladder to rest in front of the ladder with a shoulder of the moulded body resting against one stile of the ladder, the device comprising clamping means comprising at least one adjustable jaw and operating means whereby the jaw can be tightened against the underside of a rung over which the device is hooked.

There now follows a detailed description, to be read with reference to the accompanying drawings, of a device in the form of a paint tin and applicator carrier which illustrates the invention by way of example.

Figure 2:
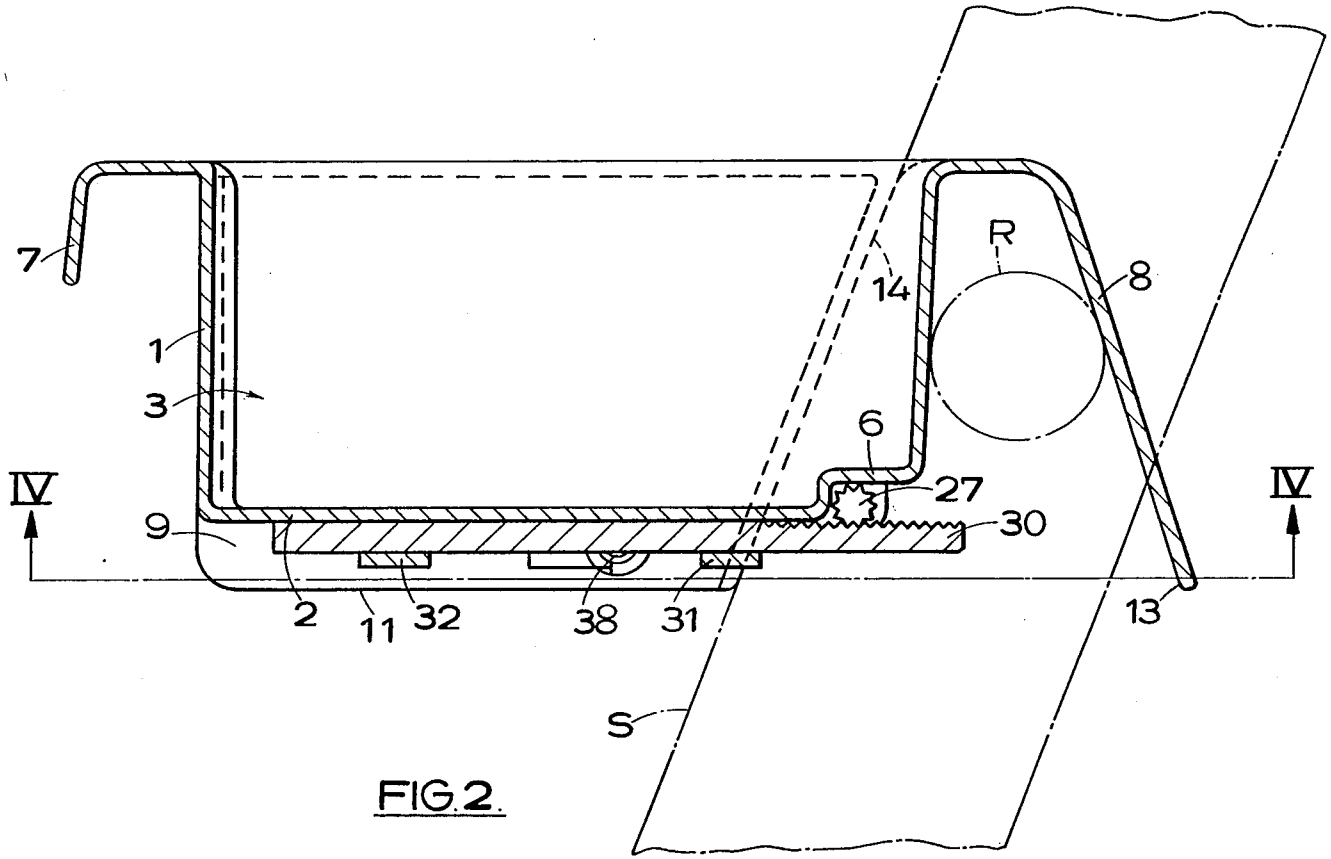
FIG. 2 is a view on section line II—II of FIG. 1, the outline of a rung and a stile of a ladder on which the device can be mounted being indicated in broken line.
Figure 7:
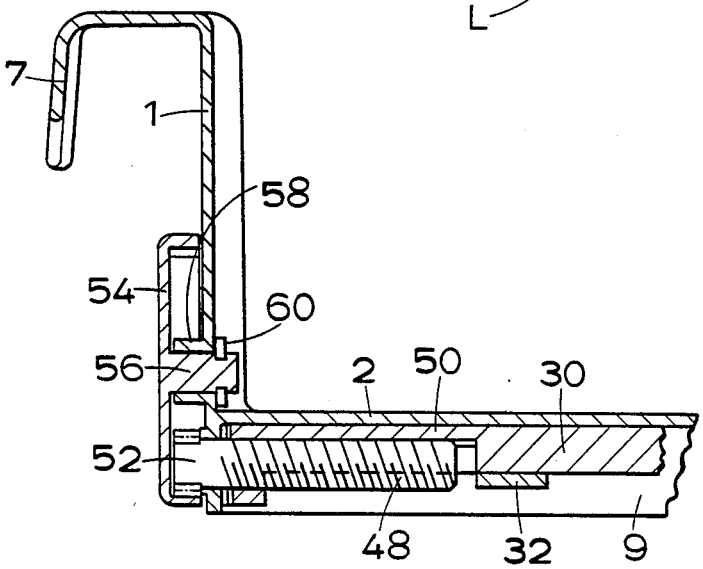
Figure 4:
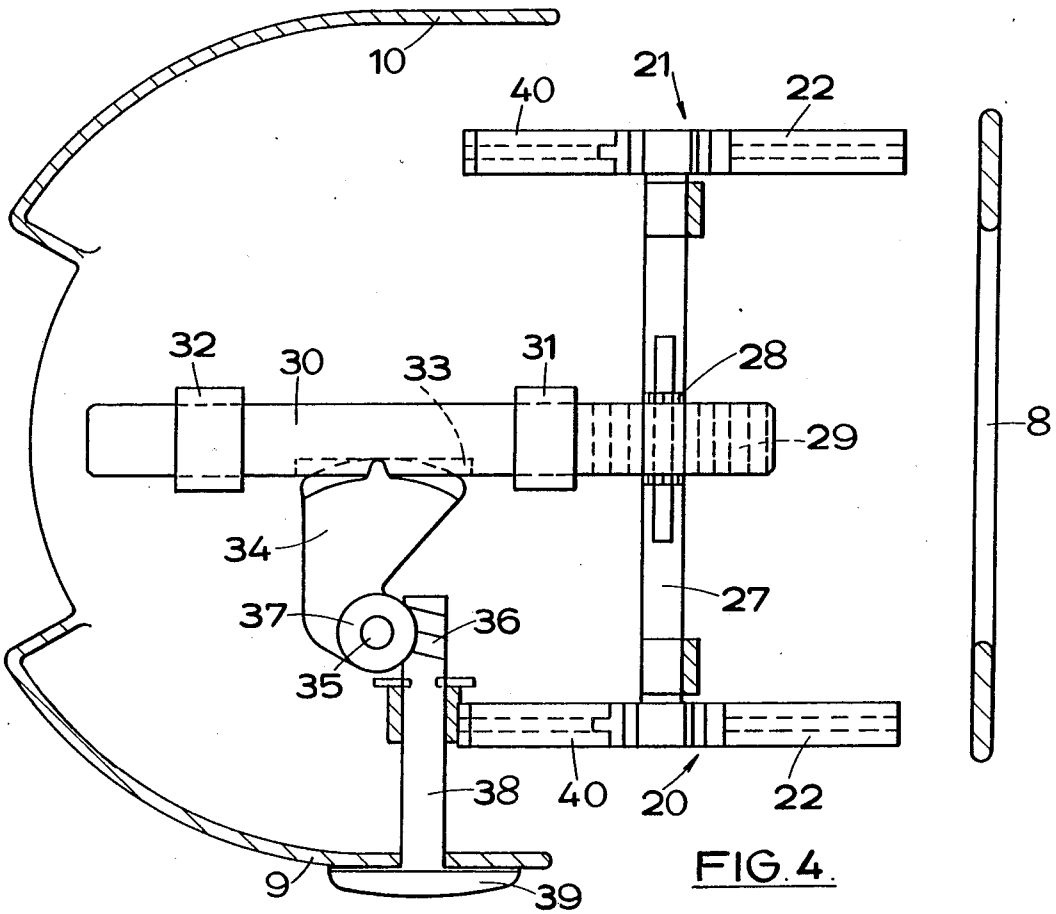
FIG. 4 is an illustration from beneath the device, on section line IV—IV of FIG. 2, showing jaw operating mechanism of the device.
Figure 6B:
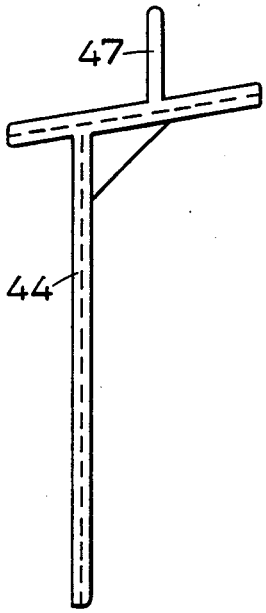
Figure 6A:
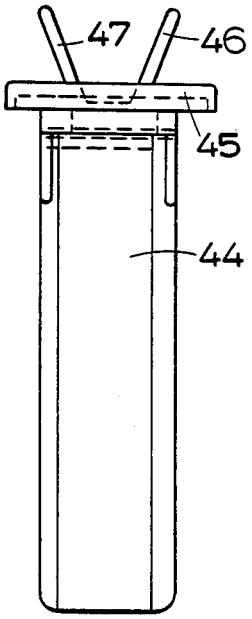
Figure 6C:
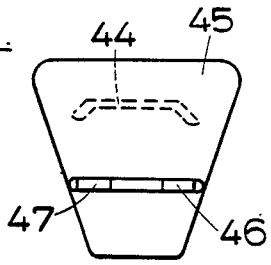

FIGS. 6*a*, 6*b* and 6*c* are back, side and top views, respectively, of a selectively positionable brush holder of the device; and FIG. 7 is a view similar to FIG. 2 illustrating alternative clamping jaw operating mechanism.

Figure 1:
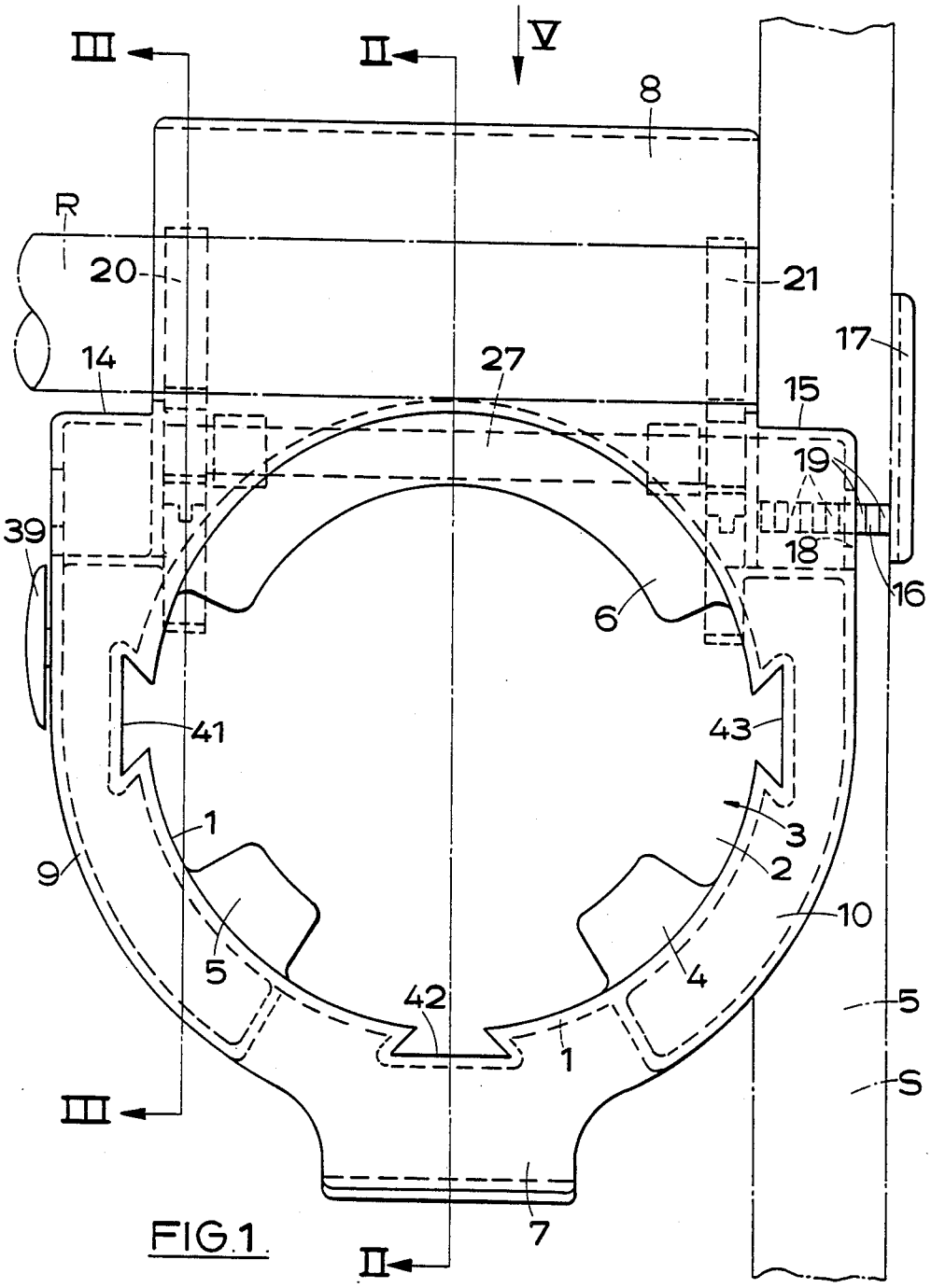
FIG. 1 is a plan view of the device.

With reference particularly to FIGS. 1 and 2 of the accompanying drawings, the device comprises an injection moulded plastics body. The body comprises a well-defining portion comprising a generally cylindrical wall 1 and a floor 2.

Uniformly spaced around the edge of the floor 2, the body comprises three portions forming stands 4, 5 and 6, of equal height, which serve to raise the floor level locally. By this means, two sizes of paint tin can be securely lodged with radial location in the well; a smaller diameter size of tin can stand on the floor 2 and be located centrally of the well by the stands 4, 5 and 6 (which abut the sides of the tin) and alternatively a larger tin size can be located by the wall 1 of the well when positioned on the stands. The stands 4, 5 and 6 might themselves be recessed to enable a third, intermediate, size of tin to be located.

Figure 5:
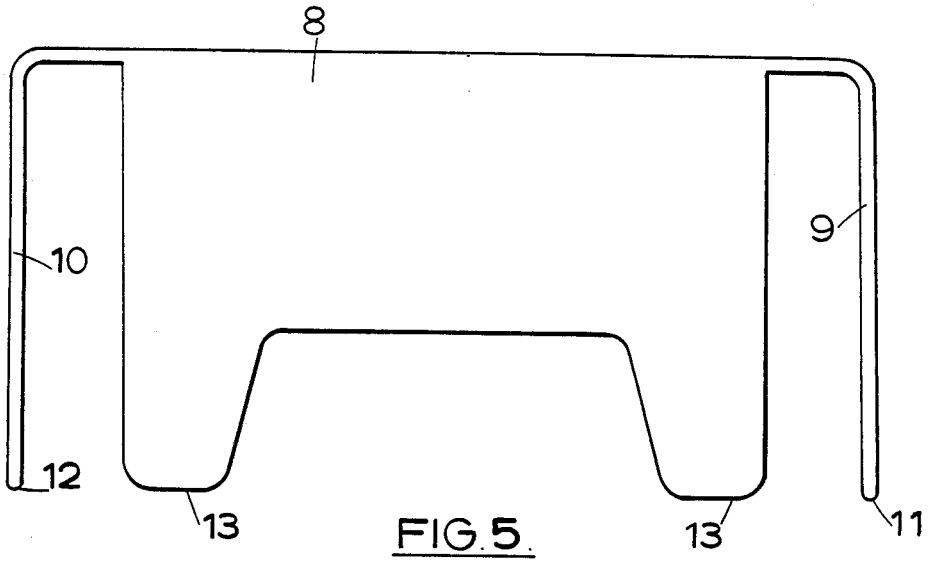
FIG. 5 is a diagrammatic rearend illustration of the device, taken in the direction of arrow V of FIG. 1.

The moulded body comprises also front and rear portions in the form of hooking webs 7 and 8, respectively, at opposite ends of the device, the webs projecting outwards and downwards from the top of the wall 1. The body also comprises side skirting 9 and 10 (see also FIG. 5) which, like the webs 7 and 8, projects outwards and downwards from the top of the wall 1. The skirting 9 and 10 and the rear hooking web 8 present bottom edges 11, 12 and 13, respectively, which lie in a common plane at a level spaced beneath the well floor 2, so enabling the device to be stood stably on a level surface.

As indicated in FIGS. 1 and 2, the moulded body provides two flat rearwardly-facing shoulders 14 and 15, disposed as rear end faces of the side skirting 9 and 10. The two shoulders lie in the same plane. The rear hooking web 8 is suitably shaped relative to an adjacent portion of the wall 1 to hang over a ladder rung (indicated at R in FIG. 2) and the shoulders 14 and 15 are arranged so that one or the other can bear against one of the stiles S of the ladder, as appropriate in mounting the device to one side or the other of the ladder. The device is adapted to be mounted on a ladder (from the front) by hooking the web 8 over one end portion of a rung R at a suitable height, and pivoting the device downwardly about the rung until the appropriate one of the shoulders 14 and 15 rests on a front face of the adjacent stile S.

To prevent the device from sliding along the rung R away from the stile S, the shoulder 14 or 15 being otherwise free to slide sideways from the stile, a retaining member can be arranged to bear against a side face of the stile, as shown in FIG. 1. The retaining member comprises a stem 16 and a head 17, the arrangement being such that by feeding the stem a suitable distance through an oval aperture 18 in the skirting of the moulded body, and rotating the member, a suitable pair of a plurality of similar spaced-apart oval flanges 19 of the stem can be engaged before and behind the skirting with the head 17 of the member overlying the side rail of the ladder.

Figure 3:
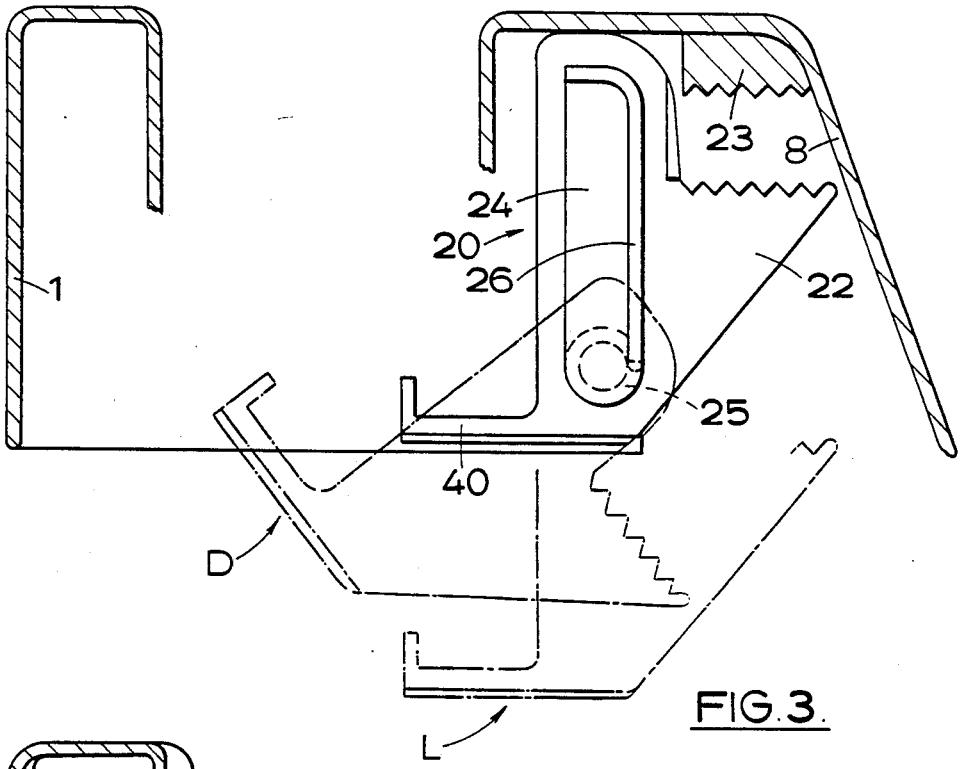
FIG. 3 is an illustration, generally on section line III—III of FIG. 1, indicating the arrangement of one of two similar clamping jaws of the device.

The device comprises clamping means whereby it can be clamped to the ladder rung R over which it is hooked. The clamping means comprises two vertically movable clamping jaws 20 and 21. The jaws are arranged beneath the rear hooking web 8, with one jaw positioned towards each side of the device as indicated in FIG. 1, to be guided suitably by portions of the moulded body. One of the two adjustable jaws is shown in FIG. 3 in a fully raised position. Each of the jaws comprises a rearwardly projecting gripping portion 22 which is vertically opposed to a fixed abutment block 23 positioned on the underside of an uppermost portion of the hooking web 8; by means of this arrangement a ladder rung can be gripped between the two jaws 20 and 21 and the respective blocks 23, by raising the jaws to engage the underside of the rung after the device has been hooked over the rung.

Mechanism of the clamping means for operating the movable jaws 20 and 21 will now be described. The vertical movement of each jaw is guided by its engagement with the moulded body. With reference to FIG. 3, each of the jaws is arranged to move in a controlled manner between an uppermost psoition (as the jaw 20 shown in full line), a lowermost position (indicated at L in broken line) and a deflected position (indicated at D in broken line). Each jaw being arranged similarly, with reference to FIG. 3 the jaw 20 is seen to have in it an elongate vertical slot 24. The two long walls of the slot are in parallel, and between them is accommodated a toothed pinion 25. The pinion is in engagement with rack teeth 26 of the jaw 20, the teeth being moulded intergrally with the jaw 20 and extending continuously up a rear face and along a short top face bounding the slot. By means of this arrangement, upon suitably rotating the pinion 25 (being mounted to rotate about a fixed axis) the jaw 20 can not only be raised and lowered but furthermore deflected forwardly, by a rotation about the pinion axis, upon the pinion reaching the rack teeth along the top face of the slot 24. It is to be noticed from FIG. 3 that when the jaw is in its deflected position D the gripping portion 22 of the jaw is moved aside (away from the hooking web 8) to permit the device to be hooked over a ladder rung. After hooking the device on to a rung the pinion 25 can then be operated to move the jaw 20, back towards its uppermost position until the rung is firmly clamped between the jaw and the associated abutment block 23 of the moulded body.

The two pinions 25, engaged respectively with the two jaws 20 and 21, are coupled for rotation together by means of a drive shaft 27 extending between them (FIGS. 1, 2 and, more especially, 4). The shaft 27 is horizontal, in the normal working orientation of the device, extending transversely of the device. A central portion 28 of the shaft 27 is in the form of a gear spindle which is engaged by rack teeth 29 provided on an uper side of a rear end portion of a flat drive bar 30 extending therebeneath. The drive bar 30 is slidably supported by spaced-apart mounting loops 31 and 32 depending from the underside of the floor 2 of the body. The bar 30 so extends, beneath the floor 2 of the body, longitudinally of the device and forwardly from the drive shaft 27. At a position between the two mounting loops 31 and 32, an edge portion of the blade 30 comprises rack teeth 33 which are engaged by an arcuate array of teeth of a pivotally mounted rotor 34. The rotor 34 is mounted on the underside of the floor 2 for rotation about a pivot axis 35 perpendicular to the drive bar 30 and drive shaft 27. Accordingly, by pivotal movement of the rotor 34 the bar 30 can be moved longitudinally to rotate the shaft 27, so to rotate the pinions 25 and raise or lower (depending upon the direction of rotation of the rotor) the jaws 20 and 21. Movement of the rotor 34 is achieved by means of a worm 36 engaging a pinion 37 of the rotor, a shaft 38 of the worm extending out through one side of the device to an operating handle 39 adjacent to the skirting 9 at that side of the moulded body. As seen in FIG. 2, the mechanism is accommodated beneath the floor 2 above the level of the bottom edges 11, 12 and 13 of the skirting 9 and 10 are the rear hooking web 8.

To afford greater versatility in use, in securement of the device at convenient mounting points, the moulded body provides the front hooking web 7 in addition to the rear hooking web 8. Tkhis is arranged in association with adjacent portions of the well-defining wall 1 of the moulded body to enable the device to be hooked in a stable manner on to, for example, a domestic central heating radiator. Furthermore, each of the two jaws 20 and 21 comprises a forwardly projecting clamping limb 40 (FIG. 3) whereby the device can be clamped, for example, to a step of a step ladder or to an edge portion of a table top on which it rests on its level bottom edges 11, 12 and 13; with the clamping jaws 20 and 21 lowered, the device can be placed on the table (at its edge) and the jaws then raised until their limbs 40 press firmly upwardly against the underside of the table top. When the jaws are in their uppermost positions (as shown in FIG. 3) the clamping limbs 40 are accommodated wholly above the level of the bottom edges 11, 12 and 13.

The device comprises also holding means to enable a paint brush (or other applicator) to be lodged when not in use. As seen in FIG. 1, the generally cylindrical well-defining wall 1 of the moulded body is recessed to provide three similar axially-extending dovetail slots 41, 42 and 43 at 90° intervals about the well axis. A correspondingly shaped stem 44 of a brush holder (FIG. 6) can be inserted downwards into whichever of the three slots is most convenient for the user. A head portion of the holder, at one end of the stem 44, comprises a support plate 45 and two ears 46 and 47 forming a wedge-shaped notch above the plate. A brush handle can be lodged in the notch, with the brush resting (inclined downwardly) on the support plate, the bristles overhanging a paint tin in the well when the stem 44 of the holder is inserted into a suitable one of the dovetail slots. The head portion of the holder can be set at a suitable height above the tin, interference between the stem 44 and the walls of the dovetail slot retaining the holder frictionally at whatever depth of insertion it is set.

An alternative form of clamping jaw operating mechanism is illustrated by FIG. 7. Instead of the pivotally mounted rotor 34 and the associated worm drive arrangement, a drive screw 48 is rotatably mounted in an aperture in the well-defining wall 1 beneath the front hooking portion 7. The drive screw 48 is aligned longitudinally of the drive bar 30 and is received in threaded engagement with a front end portion 50 of the bar; accordingly, by rotation of the drive screw the bar can be moved longitudinally to operate the clamping jaws 20 and 21. For rotation of the drive screw 48, a head portion 52 of the drive screw is in the form of a toothed pinion engaging internal teeth of a gear ring, in the form of an operating wheel 54, in an epicyclic gear arrangement. The wheel 54 is rotatably mounted on the wall 1 (with its axis above that of the drive screw 48) by means of an integrally moulded spindle 56 which projects through a sleeve providing portion 58, formed in the wall 1, and is retained by means of a spring clip 60. By rotation of the operating wheel 54 in the appropriate direction, the jaws 20 and 21 can so be raised and lowered.

We claim:

1. A portable device for temporary attachment to a ladder for bearing materials, tools or other requisites for a person working from the ladder, the device comprising a body forming a suitable receptacle for such requisites and also forming hooking means so shaped and positioned in projecting from the receptacle as to enable the body to be hooked over a rung of the ladder to rest against the front of the ladder with the receptacle presented for use, the device comprising at least one clamping jaw guided on the body for movements towards and away from the underside of the hooking means, means of the clamping jaw forming a toothed rack, a toothed pinion wheel in mesh with the rack, a rotatable drive shaft coupled with the pinion for rotation of the shaft and pinion together, and shaft rotating means coupled to the drive shaft whereby the drive shaft can be rotated to rotate the pinion and move the jaw relative to the body to clamp or release a rung positioned between the jaw and the hooking means and over which the device is hooked.

2. A device according to claim 1 comprising two spaced-apart clamping jaws guided on the body for movements towards and away from the underside of the hooking means, means of each clamping jaw forming a toothed rack, and two toothed pinion wheels in mesh with the two racks, the drive shaft being coupled in common with the two pinions for rotation of the shaft and pinions together.

3. A portable device for temporary attachment to a suitable support for bearing materials, tools or other requisites for a person working in the vicinity of the support, the device comprising a body forming a receptacle for such requisites, clamping means comprising at least one clamping jaw guided on the body for movements relative thereto, and jaw driving means mounted on the body and operatively coupled to the clamping means whereby the jaw or jaws can be moved relative to the body to clamp or release a support positioned between the clamping means and the body, the body forming hooking means in addition to said receptacle said hooking means being so shaped and positioned in projecting from the receptacle as to enable the body to be hooked over a rung of a ladder to rest against the front of the ladder with the receptacle presented for use and the or each jaw of the clamping means comprising a first gripping portion opposed to the underside of said hooking means whereby the device can be secured to a ladder rung and a second gripping portion opposed to the underside of the receptacle whereby the device can be secured to a table top or the like.

4. A device according to claim 1 wherein said shaft rotating means comprises a toothed drive bar supported for movements along its length by the body and in mesh with a toothed portion of the drive shaft as a rack and pinion coupling for rotation of the drive shaft.

5. A device according to claim 4 in which said shaft rotating means comprises a rotor pivotally mounted on the body and in toothed engagement with the drive bar and a worm drive in toothed engagement with the rotor for rotation of the rotor to move the drive bar along its length.

6. A device according to claim 4 in which said shaft rotating means comprises a drive screw in threaded engagement with an end portion of the drive bar for movement of the drive bar along its length upon rotation of the screw, a head portion of the drive screw being in the form of a pinion rotatable by means of an operating wheel, the wheel forming a gear ring which is engaged internally by the pinion in an epicyclic gear arrangement.

7. A device according to claim 12 in which the body presents a shoulder arranged to rest against one stile of the ladder when the device is in position hooked over a rung.

8. A device according to claim 1 in which said at least one jaw comprises a first gripping portion opposed to the underside of said hooking means and a second gripping portion opposed to the underside of the receptacle, whereby the device can be clamped either to a rung of a ladder or to a table top, or the like, respectively.

9. A device according to claim 12 in which said body forms a well to receive a paint pot or pail.

10. A device according to claim 9 in which a well-defining wall of the body is recessed to provide a plurality of dovetail slots spaced about the well axis, there being associated with the device a paint applicator holder which can be lodged in any one of the slots.

* * * * *